United States Patent [19]

Perobelli et al.

[11] Patent Number: 4,979,348

[45] Date of Patent: Dec. 25, 1990

[54] SEALING FILM APPLYING MACHINE, ADAPTED FOR PACKAGING PARCELS, BOOKS, SIGNATURES AND BROCHURES, EVEN INDIVIDUALLY, BY MEANS OF A WRAPPING WEB

[75] Inventors: Aldo Perobelli; Giorgio Pessina, both of Cusan Milanino, Italy

[73] Assignee: O.M.G. di Giorgio PESSINA e Aldo PEROBELLI S.n.c., Milan, Italy

[21] Appl. No.: 334,090

[22] Filed: Apr. 5, 1989

[30] Foreign Application Priority Data

Apr. 18, 1988 [IT] Italy ..... 20240 A/88

[51] Int. Cl.[5] ..... B65B 11/08

[52] U.S. Cl. ..... 53/228; 53/218

[58] Field of Search ..... 53/203, 218, 229, 228, 53/553, 556, 442

[56] References Cited

U.S. PATENT DOCUMENTS

| | | | |
|---|---|---|---|
| 2,928,217 | 3/1960 | Case et al. | 53/228 X |
| 2,931,148 | 4/1960 | Smith | 53/228 X |
| 4,102,112 | 7/1978 | Rose | 53/228 |
| 4,167,841 | 9/1979 | Camp | 53/228 X |
| 4,783,950 | 11/1988 | Santagati | 53/228 X |
| 4,869,051 | 9/1989 | Shifley et al. | 53/228 X |

*Primary Examiner*—James F. Coan

*Attorney, Agent, or Firm*—Dann, Dorfman, Herrell and Skillman

[57] ABSTRACT

A means for packaging parcels feeds parcels along a conveyor into a stop bar. A continuous web of thermally shrinkable film is provided from separate supplies above and below the conveyor as a barrier between the conveyor and a platform in the same plane as the conveyor. A pusher member moves the parcels laterally off of the conveyor into the web of film so that the film is withdrawn from the supplies as the parcel is pushed onto the platform. Sealing means is movable into the space between the parcel on the platform and the conveyor to press together, cut and seal the film webs leaving a new web barrier in place at the edge of the conveyor. Movable stop means on the platform into which the pusher pushes the parcel opposes the movement of the parcel but is movable in the direction of the pusher and parcel. The movable stop means has drive means controlling its movement. Sensor means is positioned to be engaged by the pusher member the parcel of the film to control the rate of movement of the movable stop.

5 Claims, 4 Drawing Sheets

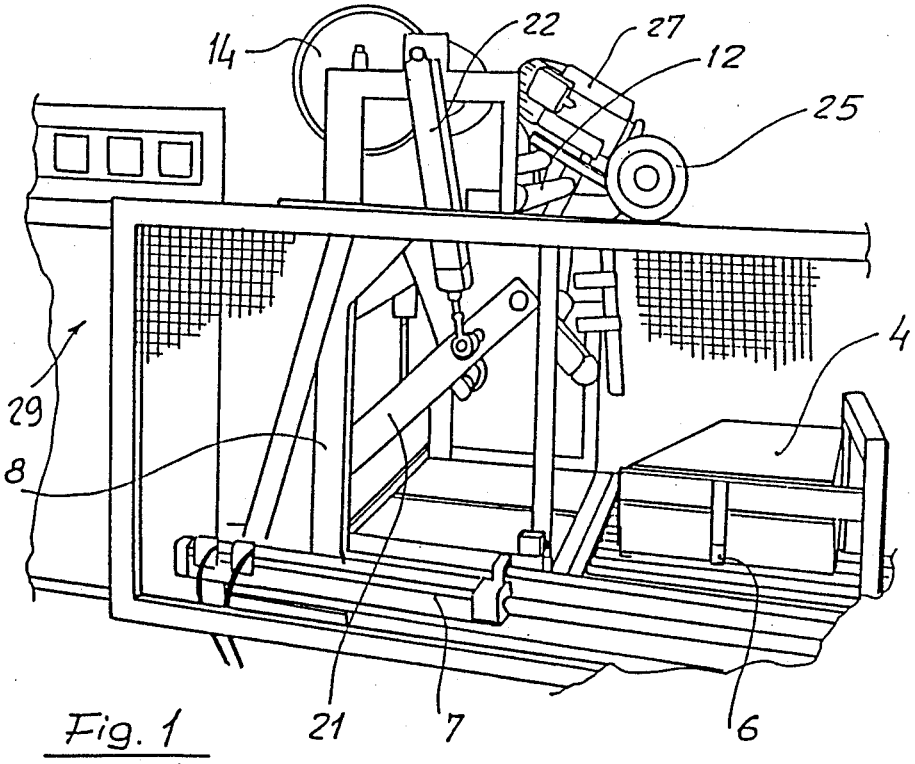
Fig. 1
Fig. 2
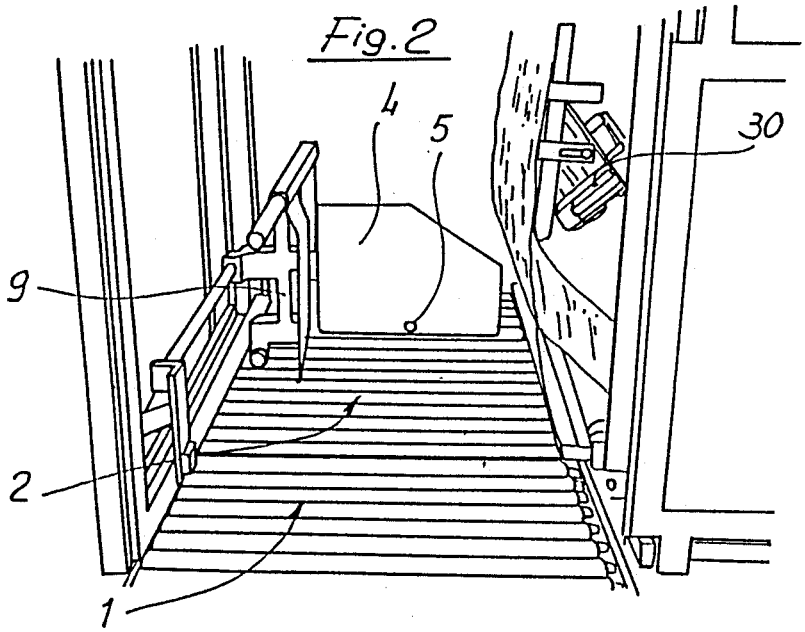

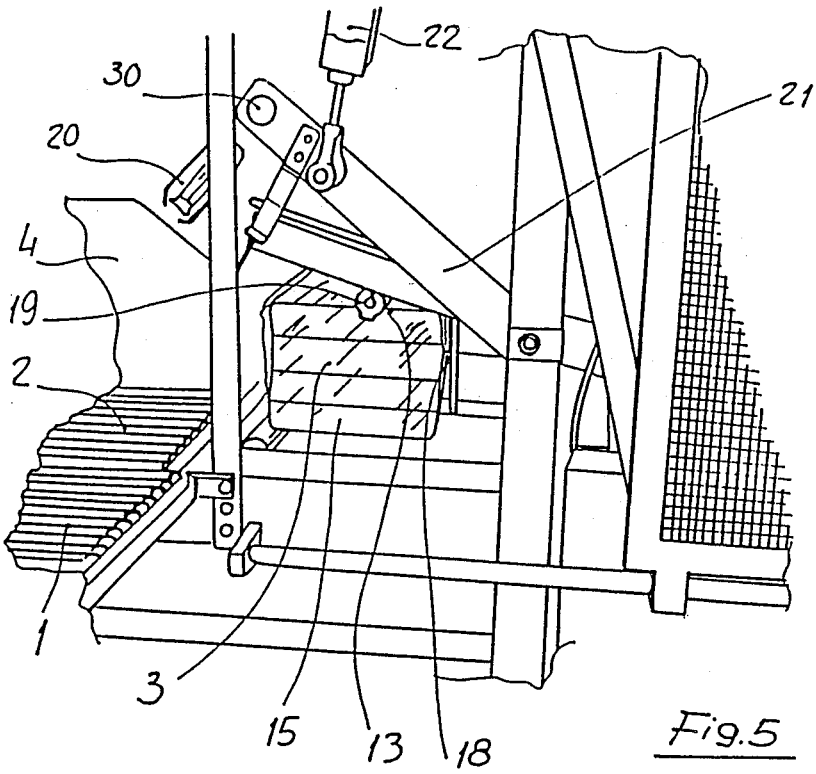
Fig. 5
Fig. 7
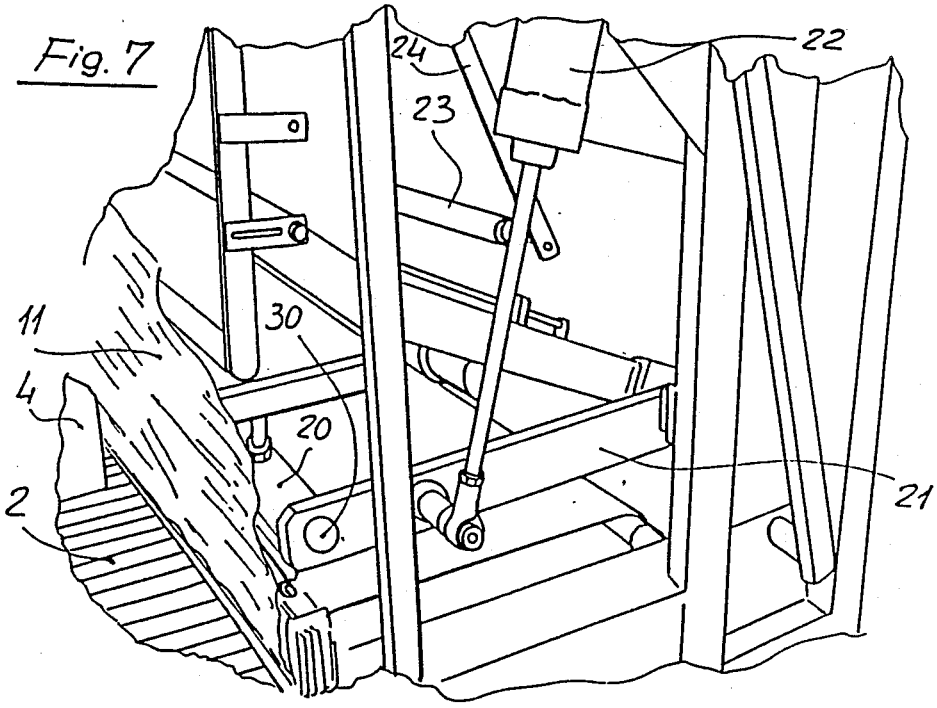

SEALING FILM APPLYING MACHINE, ADAPTED FOR PACKAGING PARCELS, BOOKS, SIGNATURES AND BROCHURES, EVEN INDIVIDUALLY, BY MEANS OF A WRAPPING WEB

The subject of this invention is an improved sealing film applying machine, adapted for packaging parcels, books, signatures and brochures, even individually, by means of a wrapping web.

As it is known, magazines, books, brochures and so on, are presently conveniently packaged both individually and in plural copies, by a thermally shrinkable plastic film packaging.

Said packaging operation is performed by means of special sealing film applying machines which usually wrap the product by means of a pair of film webs (provided on top and underneath said product), sealing them thereafter at both ends thereof.

In any case, the conventional machines used to perform the above operations have a very complicated structure, and take an undeniably large room.

Furthermore, said conventional machines are affected by operating difficulties which cannot be overcome, for packaging small thickness products (such as, for instance individual signatures) or loose sheets placed on top of each other.

A broad purpose of this invention is to correct the previously incurred drawbacks, by providing an improved sealing film applying machine, having extremely reduced overall dimensions.

Within the above broad purpose, a particular object of this invention is to provide an improved sealing film applying machine which is structurally simple and very realiable in operation.

A further object of this invention is to provide an improved sealing film applying machine which is able to perform proper packaging also on individual signatures or brochures.

Said broad purpose, as well as the objects mentioned above, and others which might be shown in more detail in the following, are attained by an improved sealing film applying machine, according to this invention, characterized by substantially including a device for feeding the parcel, the brochure, or the like, to be packaged, a pusher being provided downstream from said device, and performing a horizontal traverse motion, relative to the main axis of said feeding device; said pusher causes the parcel or the brochure to proceed between two webs of a suitable thermally shrinkable plastic material, fed out of an upper and a lower roll respectively, and sealed at the adjacent sides, in order to form together a continuous surface; in practice, said pair of film webs wrap the upper and lower face of the parcel, or brochure, and are then sealed, downstream thereof, by means of a special sealing blade; means are further provided, for a proper general positioning of the plastic film, and for stopping in the proper position the parcel or brochure, during the packaging operation thereof.

Further features and advantages of the improved sealing film applying machine of this Invention Patent, will be better appreciated from the following description of a preferred embodiment of the subject machine, shown for purely exemplary purposes, and without any purpose of limitation, in the several Figures of the attached drawing, wherein:

FIG. 1 shows a partial schematic view of the subject machine;

FIG. 2 shows the feeding platform for the parcels to be sealed in film;

FIG. 5 shows parcel stopping devices, in the sealing film applying position;

FIG. 7 shows the step of sealing and cutting the overlying films.

Figure 3:
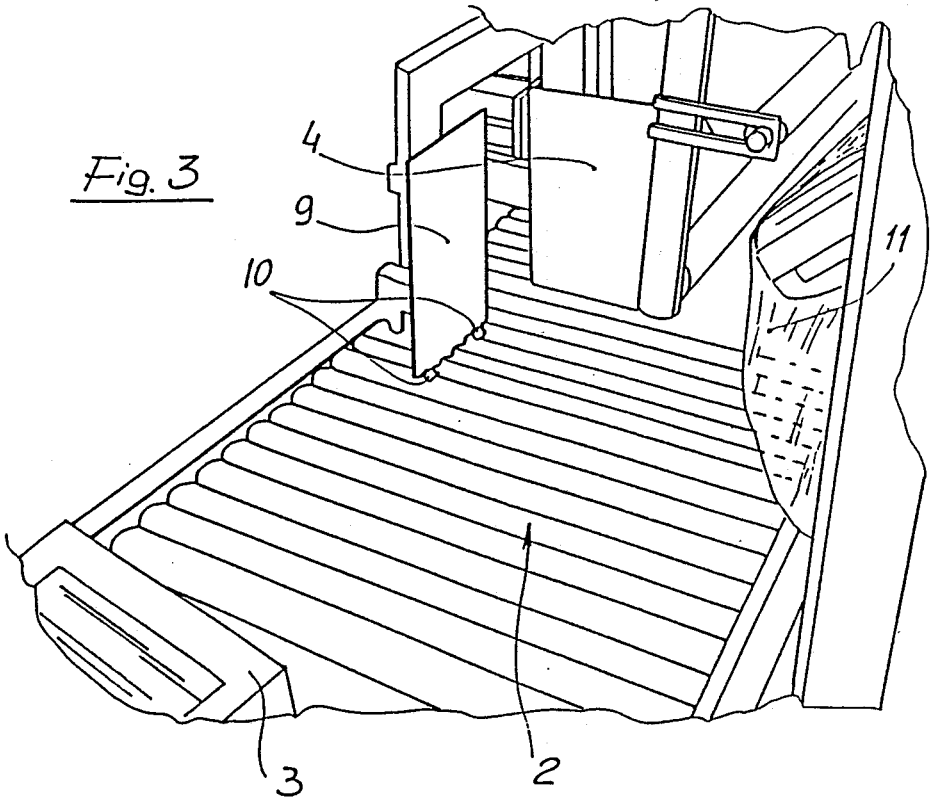
FIG. 3 shows, in particular, the roller conveyor and the pusher member.
Figure 4:
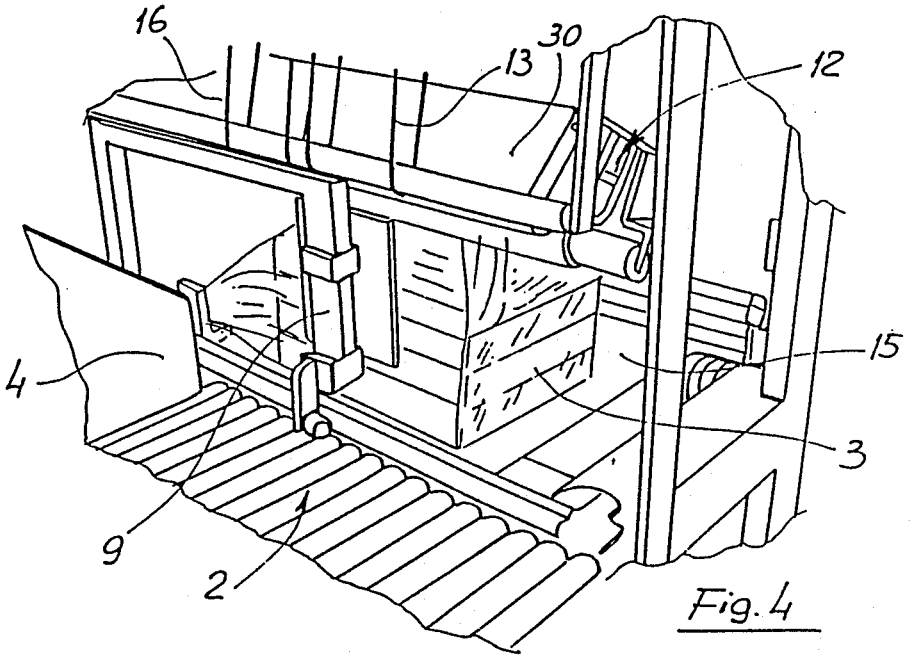
FIG. 4 shows the step of introducing the parcel in the film applying machine, by means of said pusher member.

Referring now in particular to the reference numbers in the plurality of Figures of the attached drawing, the subject sealing film applying machine preferably but not necessarily includes an intake plane, shown in general at (1), comprised of a plurality of idle rollers, mounted side by side with horizontal axis.

Downstream from said idle rollers there is provided a second plurality of rollers, (2) coplanar and parallel to the former rollers, some of them being driven, i.e. subjected to an entraining rotating motion, by means of belts or chains, or any other suitable transmission means.

The aforesaid second plurality of rollers, or "roller conveyor", causes substantially an automatic forwarding of the parcel, brochure, or the like, (3), to be sealed in film, i.e. to be wrapped by means of cellophane film, or other plastic films.

Said brochures, or parcels, are moved forward until they reach a front stop plate, (4), and at the base of said plate there is provided an opening (5) and behind the latter there is mounted a sensor, preferably comprising a photoelectric cell (6).

When the parcels come to close said opening, the photoelectric cell drives said roller conveyor to a stop and actuates a pneumatic cylinder (7), mounted along one of the sides of the machine frame (8), and adpted to drive a pusher means (9).

Said pusher member is provided, at the base thereof, with small brackets (10) at an intermediate position between pairs of forwarding roller conveyor side by side located rollers, said brackets being suitably sloping downward. More particularly, said small brackets are received between pairs of rollers, and the bending point thereof is located in a position lower than the uppermost edge of said rollers.

In practice, said small brackets allow the pusher member to subject to the proper pushing action even loose sheets, among which the ones closer to the roller conveyor might otherwise be left in place, in that they would be received in the gap which usually forms between the pusher member horizontal platform and the upper plane of said roller conveyor.

Said pusher member causes the parcel or the brochure to be packaged, to traverse across roller conveyor (2), until it is brought in contact with a plastic film (11), properly laid up in a vertical position, at the inlet opening of the actual sealing film applying apparatus shown in general at (12).

More particularly, said plastic film is comprised of a first film, (13), fed from the top downwards out of an upper roll (14) as seen in FIG. 1, and of a second film, (15), fed from the bottom upwards out of a lower roll (not shown). In practice, said pair of films are transversely sealed to each other at the adjoining edges thereof, and are tensioned due to the forward motion of the parcel, or brochure, (3), to be packaged.

Figure 6:
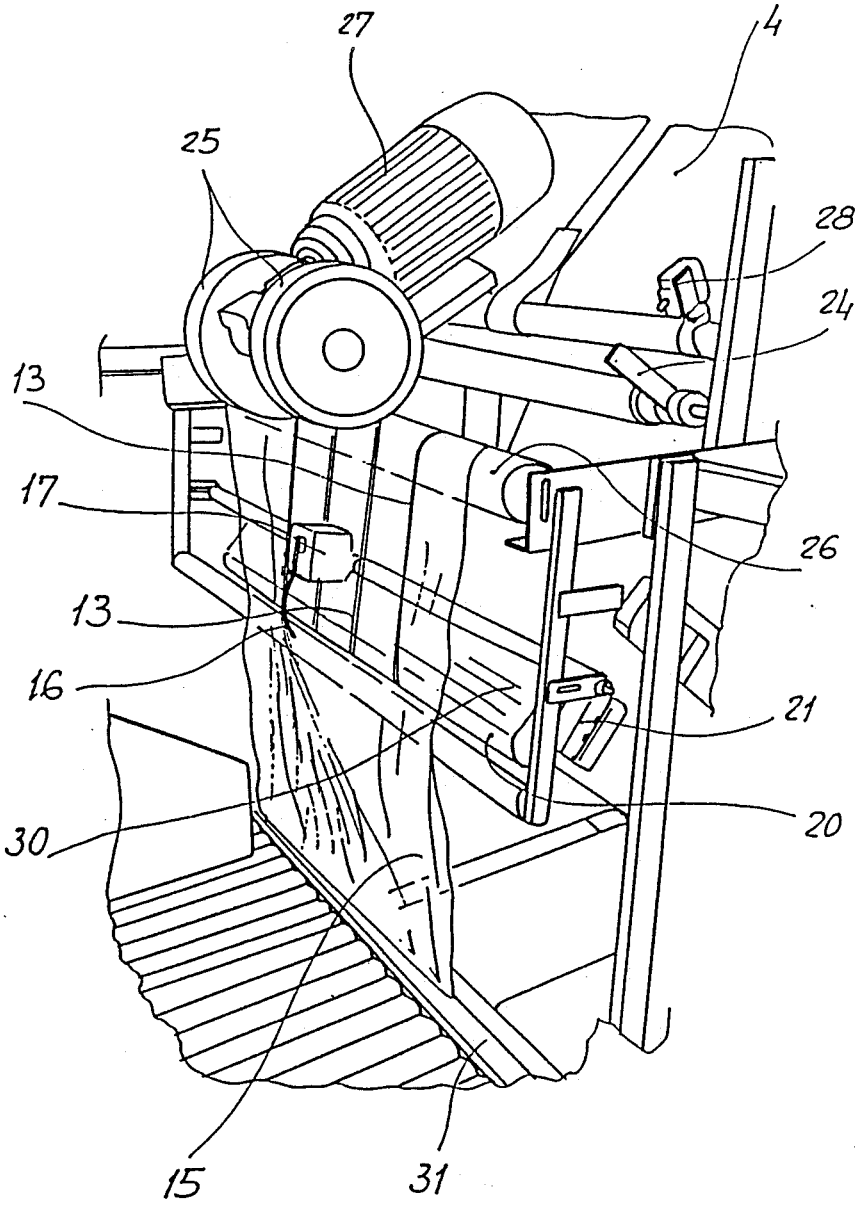
FIG. 6 shows an upper film return apparatus.

In particular, as seen in FIG. 6, general tensioning of said film brings one of the surfaces of said film to come into engagement with a suitably curved leaf spring (16), acting on a sensor (17) adapted to cause actuation of an associated motor, which in turn can rotate the above mentioned supply rolls, in opposite directions.

Owing to the above contrivance, the parcel or the brochure are able to move forward between the two films, which come to lie in contact with the upper surface and with the lower surface of said parcel or brochure, respectively.

On the path of said parcel or brochure there is provided a stop device comprising a vertical bar, (18), adapted to perform a traverse movement from the bottom upwards, and vice versa, or else comprising one or more bars, or barriers, adapted to rotate like a compass or to traverse in a direction perpendicular to the forward moving direction of the package.

In particular, actuation of said devices is automatically controlled by the action of associated sensors, engaged by the pusher member during the package entrance stroke.

Concerning the above, there should be emphasized the fact that said stop or front abutment means is extremely convenient, in that, when the parcel subjected to the forwarding action of the pusher member reaches position, it might, while stopping, easily break up.

Essentially, said effect of breaking up might take place, if said front stop means were missing, in case the entrance velocity is high, or else when the material to be handled comprises parcels of books, brochures, leaflets, or in any case papers, having the outside parts, or covers, particularly slippery.

It should be pointed out as well that the above mentioned stop devices are useful also in the case when the device for introducing the parcel in the sealing film applying machine comprises rollers, belts, mats, and so on. Another sensor, controlled by the above pusher member, causes the lowering of a pressure applying means, (19), supported by a pair of arms, adapted to be rotated, and pivoted on the struts supporting the sealing film applying apparatus.

In practice, said pressure applying member (19), keeps the parcel or leaflet, to be sealed inside a film, in stable position during the sealing film applying operation. Said sealing film applying operation is substantially performed by a sealing blade (20), pivoted on a pair of corresponding arms (21), which are driven by as many cylinders (22), said blade being adapted to seal and to cut the pair of overlapping plastic material sheets, just downstream from the wrapped parcel or brochure.

Concerning the above, it should be pointed out that the cut is performed along the axis of the sealed material band, in order to leave the two films (13) and (15) still connected at the edges thereof and ready for packaging a new parcel.

Of course sensors are provided, adapted to actuate film feeding, pusher member return, and lowering of said sealing bar or blade respectively.

A feeler roller (23) is further provided, pivoted at the lower end of swinging arms (24), and adapted to cause upper film (13) to be recalled, by means of a pair of wheels (25), pushing on idler roller (26), and driven by a suitable geared motor (27) as seen in FIG. 6.

In particular, when the film is tensioned downstream from said idler roller, said feeler roller tends to get positioned at the lowest point of its swing, while engaging, by means of the top end of one of the swinging arms, a microswitch (28), which is adapted to stop said geared motor. Then, the parcel or leaflet, or the like, wrapped between two portions of film sealed at their ends, is entered into a suitable oven (29), adapted to cause said film to thermally shrink.

It should also be emphasized that said bar comprising stop device (18) may be fastened in a position more or less displaced back relative to the intake of apparatus (12), and along the forward moving axis of pusher member (9), depending upon the length of the parcel (3) or of the leaflet to be packaged.

Furthermore, the supporting ends of cross member (30), which constrain sealing bar (20), are conveniently provided with a circular cross sectional shape.

Said shape substantially allows and promotes a perfect alignment of said sealing blade, through suitable control and stop means, with a sealing counterbar, (31). Concerning the above, it should be pointed out that said brackets (10), integral with pusher member (9) are conveniently higher relative to the counterbar mentioned above.

Owing to that feature, the pusher member, in its parcel introducing stroke, may cause the latter to traverse beyond said sealing counterbar, without damaging it. From what has been described above, and from observation of the various Figures of the attached drawing, it should be apparent the higher functionality and possibility of practical use, which characterize the improved sealing film applying machine making the subject of this Invention Patent.

Obviously, the machine has been previously described and illustrated for purely exemplary and non limiting purposes, only to demonstrate the practical feasability of the general features of this invention; therefore, it will be possible to introduce in said apparatus all the variations and modifications which might be apparent to those skilled in the art, and included in the scope of the inventive concepts disclosed above.

What we claim is:

1. A machine for packaging parcels, including sheets or books, with a sealing film comprising:

a support frame;

a conveyor on the support frame for feeding parcels along the conveyor into a stop bar;

a platform generally in the plane of the conveyor;

supports for separate supplies of continuous webs of thermally shrinkable film supported on the frame along an edge of the conveyor adjacent the stop bar between the conveyor and the platform and located above and below the conveyor with adequate clearance for parcels to be packaged such that the webs of film from the supplies when joined together form a barrier between the conveyor and the platform;

a pusher member having means supported on the frame to move the pusher member relative to the conveyor toward the platform transverse to the conveyor to move parcels laterally off the conveyor into joined webs of film so that the film is withdrawn from the supplies onto the platform around the parcel, whereby as the parcel is pushed onto the platform the webs of films wrap substantially the upper and lower surface of the parcel;

sealing means supported on the frame, at least a portion of which is movable relative to the frame into the space between the parcel on the platform and the conveyor to press the film together and cut and seal together the webs leaving a new web barrier in place at the edge of the conveyor;

movable stop means on the platform into which the pusher member pushes the parcel, opposing the movement of the parcel and movable in the direction of movement of the pusher and parcel;

drive means for the movable stop controlling its rate of movement; and sensor means positioned to be engaged by the pusher member, the parcel or the film and controlling the rate of movement of the movable stop.

2. The machine according to claim 1, characterized in that said conveyor comprises a plurality of adjacent rollers mounted on horizontal axes, and said pusher member is provided, at the base thereof, with suitable brackets projecting downwards to be received between adjacent pairs of rollers and bent to extend between the parallel rollers.

3. The machine according to claim 1, characterized in that adjacent the stop bar there is provided a sensor positioned to sense when a parcel reaches the stop bar and controlling the actuation of said pusher member.

4. The machine according to claim 1, characterized in that it includes a sensor which, under the action of said pusher member, causes lowering of a press member, supported on the support frame by a pair of pivoting arms and adapted to keep the parcel to be sealingly packaged in a stable position during the sealing film applying operation.

5. The machine according to claim 1, characterized in that said movable stop means is variably displaced back from the vertical plane containing the film and along the forward moving direction of said pusher member depending upon the length of the parcel to be packaged.

* * * * *

UNITED STATES PATENT AND TRADEMARK OFFICE

CERTIFICATE OF CORRECTION

PATENT NO. : 4,979,348

DATED : December 25, 1990

INVENTOR(S) : Aldo Perobelli and Giorgio Pessina

It is certified that error appears in the above-identified patent and that said Letters Patent is hereby corrected as shown below:

Column 2, line 40, "adpted" should read --adapted--.

Signed and Sealed this

Twenty-sixth Day of May, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,979,348

DATED : December 25, 1990

INVENTOR(S) : Aldo Perobelli and Giorgio Pessina

It is certified that error appears in the above-identified patent and that said Letters Patent is hereby corrected as shown below:

Claim 1, Column 5, line 7, delete "of" and insert --perpendicular to--.

Signed and Sealed this

Seventh Day of September, 1993

Bruce Lehman

*Attest:*

BRUCE LEHMAN

*Attesting Officer*

*Commissioner of Patents and Trademarks*